US011518563B2

(12) United States Patent
Gryxa et al.

(10) Patent No.: US 11,518,563 B2
(45) Date of Patent: Dec. 6, 2022

(54) APPARATUS FOR PACKAGING SHEET MATERIAL

(71) Applicant: Giesecke+Devrient Currency Technology GmbH, Munich (DE)

(72) Inventors: Reinhold Gryxa, Munich (DE); Harald Braun, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 6 days.

(21) Appl. No.: 16/793,525

(22) Filed: Feb. 18, 2020

(65) Prior Publication Data

US 2020/0262595 A1 Aug. 20, 2020

(30) Foreign Application Priority Data

Feb. 18, 2019 (DE) ..... 10 2019 001 174.0

(51) Int. Cl.

| | |
|---|---|
| ***B65B 57/02*** | (2006.01) |
| ***B65B 9/02*** | (2006.01) |
| ***B65B 11/10*** | (2006.01) |
| ***B65B 27/08*** | (2006.01) |
| ***B65B 57/18*** | (2006.01) |
| ***B65H 26/06*** | (2006.01) |

(52) U.S. Cl.

CPC ..... *B65B 57/02* (2013.01); *B65B 9/026* (2013.01); *B65B 11/10* (2013.01); *B65B 27/08* (2013.01); *B65B 57/18* (2013.01); *B65H 26/06* (2013.01); *B65H 2511/114* (2013.01)

(58) Field of Classification Search

None

See application file for complete search history.

(56) References Cited

U.S. PATENT DOCUMENTS 3,559,367 A * 2/1971 Misik ..... B65B 25/14 53/553
3,564,810 A * 2/1971 Faletti et al. ..... B29C 66/431 100/17
4,047,359 A * 9/1977 Gronebaum ..... B65B 9/026 53/64

(Continued)

FOREIGN PATENT DOCUMENTS

DE 3210982 A1 4/1983
DE 3237374 A1 5/1983

(Continued)

OTHER PUBLICATIONS

Search Report from corresponding EP Application No. EP20020070, dated Jun. 1, 2020.

*Primary Examiner* — Hemant Desai
*Assistant Examiner* — Tanzim Imam
(74) *Attorney, Agent, or Firm* — Workman Nydegger

(57) ABSTRACT

An apparatus is arranged for packaging sheet material, in particular banknotes, vouchers, checks, separation cards, etc., with a packaging device, packaging material dispensed from a roll for packaging the sheet material, and a control device controlling the apparatus. A monitoring device is provided for the packaging material, and the control device evaluates a signal of the monitoring device during the packaging of sheet material, in order to derive therefrom whether packaging material is present on the roll.

16 Claims, 2 Drawing Sheets

(56) References Cited

U.S. PATENT DOCUMENTS

| | | | | | |
|---|---|---|---|---|---|
| 4,509,314 | A * | 4/1985 | Bozza | B65B 11/10 | 53/228 |
| 4,541,221 | A | 9/1985 | Seragnoli | | |
| 4,991,376 | A * | 2/1991 | Backman | B65B 9/026 | 53/399 |
| 5,177,932 | A * | 1/1993 | Schmetzer | B31F 5/025 | 53/550 |
| 5,187,922 | A * | 2/1993 | Mast | B65B 9/026 | 53/229 |
| 5,524,413 | A * | 6/1996 | Fukuda | B65B 9/20 | 226/100 |
| 6,085,487 | A * | 7/2000 | De Vlaam | B65B 27/08 | 100/17 |
| 6,282,868 | B1 * | 9/2001 | Vlaam | B65B 11/10 | 53/399 |
| 6,318,053 | B1 * | 11/2001 | Frank | B65B 9/026 | 53/586 |
| 6,470,655 | B1 * | 10/2002 | Schwede | B65B 25/14 | 53/157 |
| 6,991,391 | B2 * | 1/2006 | Maruyama | B65H 26/066 | 400/613 |
| 7,503,153 | B2 * | 3/2009 | De Matteis | B65B 25/14 | 53/223 |
| 7,828,239 | B2 * | 11/2010 | Ito | B65H 16/06 | 242/598.3 |
| 2003/0226455 | A1 | 12/2003 | Dopfer et al. | | |
| 2004/0140044 | A1 | 7/2004 | Rassi et al. | | |
| 2006/0249620 | A1 * | 11/2006 | Huil | B65H 23/00 | 242/563.2 |
| 2010/0326016 | A1 * | 12/2010 | Smith | B65B 43/54 | 53/437 |
| 2012/0318905 | A1 * | 12/2012 | Pedercini | B65H 26/08 | 242/563.2 |
| 2016/0362258 | A1 * | 12/2016 | Anders | B65G 47/32 | |
| 2018/0257802 | A1 * | 9/2018 | Resch | B65B 57/02 | |
| 2019/0127093 | A1 * | 5/2019 | Johnson | B65B 57/04 | |

FOREIGN PATENT DOCUMENTS

| | | | | |
|---|---|---|---|---|
| DE | 10225705 | A1 | 12/2003 | |
| DE | 10301347 | A1 | 2/2004 | |
| DE | 102005000697 | A1 | 7/2006 | |
| DE | 102009016976 | A1 | 10/2010 | |
| DE | 202013101694 | U1 | 7/2014 | |
| EP | 0668229 | A1 | 8/1995 | |
| EP | 1714926 | A2 | 10/2006 | |
| EP | 2860116 | A1 | 4/2015 | |
| FR | 2670927 | A1 | 6/1992 | |
| JP | S57131658 | A | 8/1982 | |
| WO | WO-2014170088 | A1 * | 10/2014 | B65H 26/06 |

* cited by examiner

APPARATUS FOR PACKAGING SHEET MATERIAL

BACKGROUND

The invention relates to an apparatus for packaging sheet material, in particular banknotes, vouchers, checks, separation cards, etc.

In the processing of banknotes with banknote processing machines, banknotes to be processed are inserted in an input pocket of a singler, so that the banknotes can be grasped individually by the singler. The individual banknotes are subsequently processed in the banknote processing machine. For this purpose, the properties of the banknotes are ascertained by sensors, for example their type, i.e. denomination and currency, their authenticity, their state, i.e. their soiling, damages, etc., their fitness for further circulation, their position and orientation, etc. Depending on the ascertained properties, the further processing of the banknotes is affected, for example these are sorted into certain output pockets in accordance with the ascertained properties, in order to form stacks of banknotes. For example, stacks of 100 banknotes can be formed, which are subsequently banded automatically. For this purpose, a loop of paper or of a different material, such as a plastic foil, is placed around the stack of 100 banknotes and a packet is formed. Further, it can be provided to automatically stack several of the packets containing 100 banknotes to form parcels containing 500 or 1,000 banknotes. Parcels formed in this manner can in turn be packaged automatically, for which purpose, for example, a foil material such as a plastic foil, in particular a shrink foil, can be employed.

The above-described banding and packaging of banknotes and corresponding apparatus are known. For example, in DE 10225705 A1 the banding of banknotes is described, and in DE 10200916976 A1, the packaging of banknotes is described.

In the following, the term packaging will be employed for any banding, packaging or other enveloping or wrapping of banknotes, as long as a consumable material stored on a roll, for example paper, plastic foil or foil-type packaging material composed of different materials, is employed for this packaging.

In the operation of the known apparatus for the packaging of banknotes it has been found that processing errors occur if the packaging material employed for the packaging has run out. In this case, a packaging currently carried out cannot be carried out or cannot be carried out completely. This can have the consequence that complex manual re-processing becomes necessary, since the stacked banknotes to be packaged cannot be processed in the provided, automated workflow.

SUMMARY

Proceeding from this state of the art, it is the object of the invention to state an apparatus for the packaging of banknotes in which it can be determined that the packaging material necessary for the packaging of the banknotes is present.

The accomplishment of this object results from the features of claim 1. Further developments are the subject matter of the sub-claims.

The invention proceeds from an apparatus for packaging sheet material, in particular banknotes, vouchers, checks, separation cards, etc., with a packaging device, packaging material dispensed from a roll for the packaging of the sheet material, and a control device controlling the apparatus, wherein a monitoring device for the packaging material is provided, and the control device evaluates a signal of the monitoring device during the packaging of sheet material, in order to derive therefrom whether packaging material is present on the roll.

The advantage of the solution according to the invention is that it can be recognized by the monitoring of the packaging material during the packaging of the sheet material that packaging material required for the packaging is present. It is thus achieved that the packaging of the sheet material can be carried out.

In one embodiment it is provided that the monitoring device is formed by a rotary encoder.

The advantage of the embodiment is that by the monitoring of the rotation of the roll with the packaging material during the packaging of the sheet material, it can be recognized that packaging material required for the packaging is present. It can thus be ensured that the packaging of the sheet material can be carried out.

In further embodiments it is provided that the control device ascertains from the signal of the rotary encoder the rotational speed or a change in the rotational speed of the roll, and further ascertains from the ascertained rotational speed or the change in the rotational speed of the roll how much packaging material is present on the roll.

In further embodiments it is provided that the control device ascertains from the signal of the rotary encoder the number of revolution of the roll per packaging process and further ascertains from the ascertained number of revolutions of the roll per packaging process how much packaging material is present on the roll.

The advantage of the further embodiment is that the control device can ascertain from the ascertained rotational speed or from the ascertained change in the rotational speed of the roll or the ascertained number of revolutions of the roll per packaging process how much packaging material is still present on the roll. This permits giving an indication to an operator so that a timely exchange of the roll with the packaging material can be effected, or at least can be prepared in timely manner. It can be prevented thereby that a failure of the apparatus for packaging sheet material occurs, since the stock of the packaging material stored on the roll has been used up during a packaging process, so that the packaging process cannot be concluded.

Further embodiments and advantages of the invention will hereinafter be explained with reference to the figures and their description.

DETAILED DESCRIPTION OF THE VARIOUS EMBODIMENTS

Figure 1A:
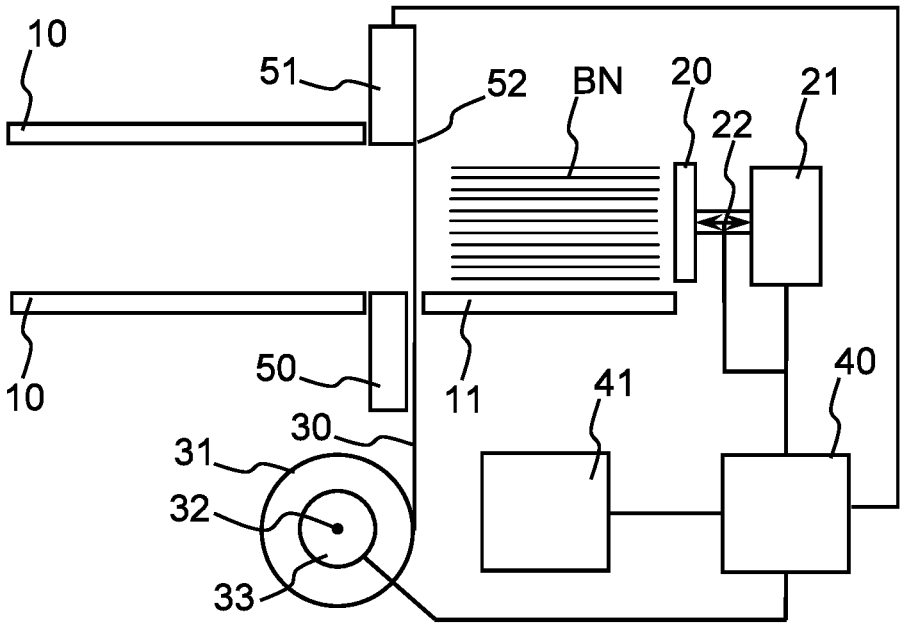
FIGS. 1*a-c* shown an embodiment of an apparatus for packaging sheet material and the packaging of a stack of sheet material.
Figure 1B:
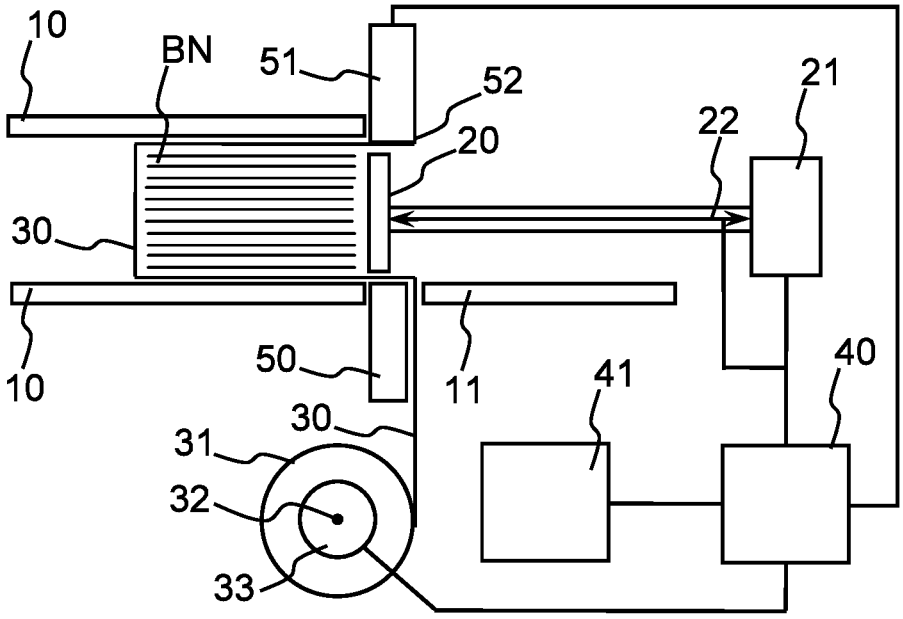
Figure 1C:
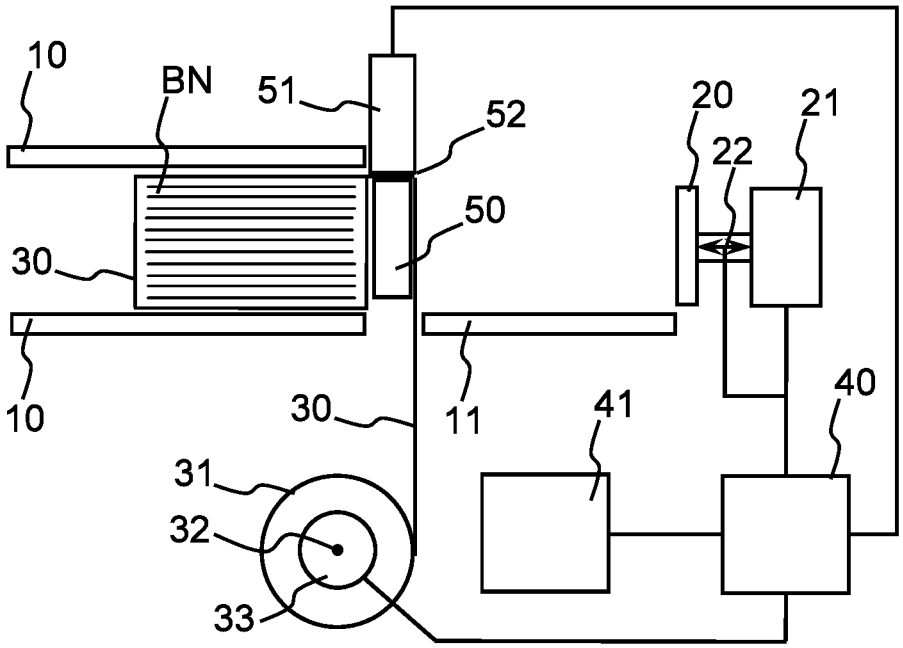

FIGS. 1*a-c* shows an embodiment of an apparatus for packaging sheet material. As explained at the outset, the term packaging is to be employed for any banding, packaging or other complete or partial enveloping or wrapping of sheet material, as long as a consumable material, for example paper, foil, plastic foil, in particular shrink foil, or foil-type packaging material composed of different materials, is employed for this packaging.

The apparatus has a deposit means 11 on which a stack of sheet material BN provided for packaging is disposed (FIG. 1*a*). The deposit means 11 can be formed, for example, by the output pocket of a banknote processing machine mentioned at the outset. In this case, the banknotes sorted into the output pocket by the banknote processing machine in accordance with certain criteria form the sheet material BN.

For packaging, the sheet material BN is pushed by means of a slider 20 having a drive 21 controlled by the control device 40, said slider being in an initial position, into a channel which can be formed, for example, by guiding plates 10 (FIG. 1*b*). When the sheet material BN is pushed into the channel, the sheet material BN is wrapped by a packaging material 30 which is unwound from a roll 31 mounted on an axle 32. The unwinding of the packaging material 30 can be affected by means of a drive driving the axle 32. It can also be provided, however, that the unwinding of the packaging material 30 is caused by the wrapping of the sheet material BN with the packaging material 30, i.e. by pushing the sheet material BN into the channel formed by the guiding plates 10 by means of the drive 21 and the slider 20. For this purpose, the drive 21 can be configured in particular as an electrical, hydraulic or pneumatic linear drive.

After the slider 20 was returned to its initial position by the drive 21, the packaging material 30 is sealed by a sealing unit 50, 51, in a manner controlled by the control device 40, so that the sheet material BN is permanently enclosed by the packaging material 30 (FIG. 1*c*). For this purpose, the sealing unit 50, 51 can have a clamping location 52 at which the packaging material 30 is clamped at the start of the packaging process. The sealing unit 50, 51 can be formed, for example, by a movable unit 50 and a stationary unit 51, wherein one unit or both units can be heated. By means of the heat produced in the unit or the units of the sealing unit 50, 51, a temperature-activatable adhesive can be activated in the packaging material 30, in order to seal the packaging material. After the sealing of the packaging material 30 by the sealing unit 50, 51, the packaging material 30 is severed in the direction of the packaged sheet material BN, so that the packaged sheet material BN can be removed. For subsequent packaging processes the packaging material 30 continues to be clamped at the clamping location 52. After removal of the packaged sheet material BN, the sealing unit 50, 51, in a manner controlled by the control device 40, is guided back to the position represented in FIG. 1*a*, so that further sheet material can be packaged.

During the above-described packaging of the sheet material BN with the packaging material 30, the control device 40 monitors whether packaging material 30 is unwound from the roll 31. For this purpose, a monitoring device 33, for example a rotary encoder, is arranged at the roll 31 or the axle 32. The rotary encoder 33 can be, for example, an electrical, magnetic, mechanic or optical rotary encoder, or any other structure that is suitable to detect the rotation of the roll 31.

When the control device 40 ascertains during the packaging by evaluating the signal of the rotary encoder 33 that the roll 31 rotates, the packaging material 30 necessary for the packaging is present on the roll 31, so that the packaging of the sheet material BN can be carried out.

When the control device 40 ascertains during the packaging by evaluating the signal of the rotary encoder 33 that the roll 31 does not rotate, the packaging material 30 necessary for the packaging is not present on the roll 31, so that the packaging of the sheet material BN cannot be carried out.

In this case, it can be provided that the control device 40 terminates the packaging process, i.e. in particular stops the drive 21 of the slider 20 and possibly guides the slider 20 back to its initial position by means of the drive 21.

However, it can also be provided, for example, by corresponding constructive configuration of the apparatus for packaging sheet material, that the packaging material 30 is sufficient for an initiated packaging process, even if the packaging material 30 has been unwound completely from the roll 31. For this purpose, for example, the distance between the roll 31 and the channel formed by the guiding plates 10 can be dimensioned such that the packaging material 30 still present there is sufficient to be able to complete the started packaging process.

Additionally, it can be provided that, upon recognizing the absence of packaging material 30 on the roll 31, the control device 40 produces an indication for an operator and displays this indication by means of a display device 41. The indication and the display device 41 can be configured acoustically and/or optically. For example, a signal tone can be sounded, or a plain-text display can be represented, for example "Please insert new roll of packaging material."

For ascertaining the presence of packaging material 30 on the roll 31 by evaluating the signals of the rotary encoder 33 it can be provided that the control device 40 evaluates the signals of the rotary encoder 33 simultaneously while the control device 40 drives the drive 21 of the slider 20 for packaging the sheet material BN. Likewise, it is possible that the slider 20 has a longitudinal encoder 22, which produces a signal during the movement of the slider 20 by the drive 21. The control device 40 then evaluates, when a signal of the lateral encoder 22 is given, whether the rotary encoder 33 also supplies a signal from which the rotation of the roll 32 can be derived.

In a further embodiment of the apparatus for packaging sheet material it is provided to recognize already at an early stage that the packaging material 30 will be used up shortly. For this purpose, the known formal parameters of the apparatus for the packaging of sheet material are evaluated by the control device 40, which allow drawing a conclusion as to the amount of packaging material 30 still present. Among these formal parameters, there are, inter alia, the speed at which the sheet material BN to be packaged is moved by the drive 21 and the slider, the size of the stack of the sheet material BN to be packaged, the diameters of a new (full) and of an empty roll 31 of packaging material.

To ascertain an amount of packaging material 30 still present, the control device 40 evaluates the rotational speed at which the roll 31 is rotating when the packaging material 30 is unwound from the roll 31 during the packaging of sheet material BN, and/or how many revolutions of the roll 31 are necessary per packaging process. The background to this is that a new (full) roll 31 has a known, larger diameter at the start, i.e. when packaging material 30 has not yet been unwound therefrom, than after a number of packaging processes. In line with an increasing number of packaging processes, the diameter 31 decreases further, so that for each new packaging process a higher number of revolutions of the roll 31 is necessary, and/or a higher rotational speed of the roll 31 results, than in the case of a new (full) roll 31 or in the case of preceding packaging processes. Accordingly, by evaluating the signal of the rotary encoder 33, the control device 40 can ascertain from the rotational speed, in particular the change in rotational speed from packaging process to packaging process and/or the number of revolutions of the roll 31 per packaging process, how much packaging material 30 is still present on the roll 31. Since the diameter of an empty roll 31, i.e. without packaging material, is also known and along therewith the formal parameters predetermined for the rotation of the roll 31 with respect to rotational speed and number of revolutions of the roll 31 per packaging process, the control device 40 can ascertain on the basis of the rotational speed and/or the revolutions per packaging process ascertained in each case how much packaging material 30 is still present on the roll 31 in each case.

Thus, the control device 40 can produce an indication already before the packaging material 30 has been used up completely and can signal to an operator by means of the display device 41 that a new roll of packaging material needs to be inserted as soon as possible.

The invention claimed is:

1. An apparatus for packaging sheet material with a packaging device for packaging the sheet material using packaging material dispensed from a roll, the apparatus comprising:

a control device arranged to control the apparatus, the control device including a monitoring device, wherein:

the monitoring device is formed by a rotary encoder, a signal of the monitoring device is evaluated by the control device during the packaging of the sheet material, the control device deriving therefrom whether the packaging material is present on the roll, the signal of the monitoring device is a rotation of the roll, the control device ascertains a rotational speed of the roll from the signal of the rotary encoder, and the control device ascertains how much of the packaging material is present on the roll from the ascertained rotational speed of the roll.

2. The apparatus according to claim 1, wherein the control device ascertains a number of revolutions of the roll per packaging process from the signal of the rotary encoder.

3. The apparatus according to claim 2, wherein the control device ascertains how much of the packaging material is present on the roll from the ascertained number of revolutions of the roll per packaging process.

4. The apparatus according to claim 1, wherein the sheet material for packaging is moved by a drive and a slider and is thereby enclosed by the packaging material, and the control device evaluates the signal of the monitoring device while the drive is active.

5. The apparatus according to claim 1, wherein the sheet material for packaging is moved by a drive and a slider with a linear encoder and is thereby enclosed by the packaging material, and the control device evaluates the signal of the monitoring device while the linear encoder supplies a signal of a movement of the slider.

6. The apparatus according to claim 1, wherein the apparatus has a display device controlled by the control device.

7. The apparatus according to claim 6, wherein the display device, in a manner controlled by the control device, outputs a warning if no packaging material is present any more on the roll.

8. The apparatus according to claim 6, wherein the display device, in a manner controlled by the control device, outputs a warning if only a small amount of the packaging material is still present on the roll.

9. The apparatus according to claim 6, wherein the display device outputs an acoustic warning.

10. The apparatus according to claim 6, wherein the display device outputs an optical warning.

11. The apparatus according to claim 1, wherein the apparatus packages the sheet material by means of a band.

12. The apparatus according to claim 1, wherein the apparatus packages the sheet material by means of a foil.

13. The apparatus according to claim 1, wherein the control device ascertains a change in a rotational speed of the roll from the rotation of the roll, which is the signal of the monitoring device.

14. The apparatus according to claim 13, wherein the control device ascertains how much of the packaging material is present on the roll from the ascertained change in the rotational speed of the roll.

15. An apparatus for packaging sheet material with a packaging device for packaging the sheet material using packaging material dispensed from a roll, the apparatus comprising:

a control device arranged to control the apparatus, the control device including a monitoring device, wherein:

the monitoring device is formed by a rotary encoder, a signal of the monitoring device is evaluated by the control device during the packaging of the sheet material, the control device deriving therefrom whether the packaging material is present on the roll, the signal of the monitoring device is a rotation of the roll, and the control device ascertains a number of revolutions of the roll per packaging process from the signal of the rotary encoder.

16. An apparatus for packaging sheet material with a packaging device for packaging the sheet material using packaging material dispensed from a roll, the apparatus comprising:

a control device arranged to control the apparatus, the control device including a monitoring device, wherein:

the monitoring device is formed by a rotary encoder, a signal of the monitoring device is evaluated by the control device during the packaging of the sheet material, the control device deriving therefrom whether the packaging material is present on the roll, the signal of the monitoring device is a rotation of the roll, and the control device ascertains a change in a rotational speed of the roll from the rotation of the roll, which is the signal of the monitoring device.

* * * * *